United States Patent [19]

Idstein

[11] 4,219,327

[45] Aug. 26, 1980

[54] FUSION FIXING APPARATUS EMPLOYING HEAT AND PRESSURE

[76] Inventor: Hermann Idstein, Johannisberger Str. 55, 6227 Oestrich-Winkel, Fed. Rep. of Germany

[21] Appl. No.: 963,725

[22] Filed: Nov. 27, 1978

[30] Foreign Application Priority Data

Nov. 30, 1977 [DE] Fed. Rep. of Germany ..... 2753299

[51] Int. Cl.[2] ..... F27B 9/28; H05B 1/00

[52] U.S. Cl. ..... 432/60; 219/216; 355/3 FU

[58] Field of Search ..... 355/3 R, 3 FU; 432/60, 432/228; 219/216

[56] References Cited

U.S. PATENT DOCUMENTS

| | | | |
|---|---|---|---|
| 3,291,466 | 12/1966 | Aser et al. | 355/3 FU X |
| 3,331,592 | 7/1967 | Cassano et al. | 355/3 FU X |
| 3,794,417 | 2/1974 | Machmer | 355/3 FU |
| 4,009,953 | 3/1977 | Ravizza et al. | 219/216 X |
| 4,019,024 | 4/1977 | Namiki | 432/60 X |
| 4,038,026 | 7/1977 | Wada et al. | 432/60 |
| 4,083,092 | 4/1978 | Imperial et al. | 355/3 FU X |

*Primary Examiner*—Fred L. Braun

*Attorney, Agent, or Firm*—Schwartz, Jeffery, Schwaab, Mack, Blumenthal & Koch

[57] ABSTRACT

An apparatus for fusion fixing thermoplastic toner images on an image carrier by use of heat and pressure, comprising a heatable fixing roller comprising a first extension tube, a first cylindrical cover surrounding the first extension tube and being comprised of an elastic, heat- and permanent deformation-resistant material, and a first tubular sleeve pulled over the first cylindrical cover, with the first tubular sleeve having a polytetrafluoroethylene surface; a pressure roller mounted adjacent to the fixing roller, the pressure roller comprising a second extension tube, a second cylindrical cover surrounding the second extension tube and being comprised of an elastic, heat- and permanent deformation-resistant material, and a second tubular sleeve pulled over the second cylindrical cover; an apparatus for selectively engaging and disengaging the pressure roller against the fixing roller; and an arrangement for driving the pressure roller and the fixing roller at the same speed when the rollers are engaged, whereby the image carrier material is transported between the rollers without blurring the images thereon.

15 Claims, 2 Drawing Figures

FUSION FIXING APPARATUS EMPLOYING HEAT AND PRESSURE

BACKGROUND OF THE INVENTION

The present invention relates to a fusion fixing apparatus employing heat and pressure and serving for fixing thermoplastic toner images. The apparatus generally comprises a heatable fixing roller with a polytetrafluoroethylene surface, a pressure roller which can be made to engage and disengage the fixing roller and which is moved from a rest position into engagement with the fixing roller by an actuating mechanism, and a wetting device for applying an anti-adhesive fluid to the fixing roller. The apparatus also comprises a driving mechanism for the rollers, which ensures that the rollers rotate at the same speed when they meet, so that the image carrier material carrying the toner images, which is positioned between the rollers, is transported without blurring the images.

In a known fusing apparatus of this type, disclosed in German Offenlegungsschriften No. 1,772,686 and No. 1,497,216, one being an application for a patent of addition to the other, the fixing roller provided with the polytetrafluoroethylene coating is heated from the inside. The pressure roller, which consists of a metal core carrying a jacket of vulcanized rubber which, in turn, is coated with a polytetrafluoroethylene coating, is caused to engage the fixing roller by an actuator. The driving mechanism for the two rollers comprises a one-way clutch which is connected with the pressure roller so that this roller can assume the same speed as the fixing roller when it meets the fixing roller. When the pressure roller is made to contact the fixing roller, the distance between the axle centers of the two rollers is reduced. The radius extending from the center of the fixing roller to its point of contact with the pressure roller remains constant because the fixing roller essentially consists of a rigid metal cylinder. The radius of the pressure roller extending from its center to the point of contact with the fixing roller is reduced by the pressure which must be applied to form a line of contact between the two rollers and ensure good fusion of the toner on the image carrier material. Upon passage of the image carrier material carrying the toner images, the imaged material is pressed against the surface of the fixing roller and possibly also against that of the pressure roller and is curved in accordance with the curvature of the fixing roller. By the natural curvature of this roller, the imaged material tends to adhere to the fixing roller during its passage through the rollers and thus interferes in an undesirable manner with the transport of the imaged material.

German Offenlegungsschrift No. 1,926,118 discloses a fixing apparatus for electrophotographic powder images in which heat and pressure are applied and which comprises a fixing roller which is heated from the outside by radiators. The fixing roller comprises several layers of silicon rubber and a toner-repellent layer, if desired, and it cooperates with a rigid pressure roller. The fixing roller possesses a certain flexibility and can be compressed when the rigid pressure roller is forced against it. The layers of silicon rubber may be replaced by highly temperature-resistant expanded rubber layers or by sealed elastic sleeves which may be made very flexible.

The heated fusion fixing apparatus disclosed in U.S. Pat. No. 3,988,817 also uses a rigid and a deformable roller. In this case, the fixing roller is rigid, whereas the pressure roller has an elastic layer which is applied to a metal core. A flexible sleeve which may consist, e.g., of fluoroethylene propylene, is pushed over this elastic layer. While the pressure roller rests against the fixing roller, a slight depression is formed in the pressure roller which corresponds to the curvature of the fixing roller surface.

These known devices have the disadvantage that a considerable compressive force is required to create a relatively large zone or area of contact between the fixing roller and the pressure roller. Due to the large expenditure on equipment which is thus required for supporting and driving the rollers, the entire driving system must be disassembled if a roller is to be replaced, which means that these devices are neither easy to service nor inexpensive.

SUMMARY OF THE INVENTION

It is the object of the present invention to provide an improved fusion fixing apparatus employing heat and pressure of the type described above.

It is also an object of the invention to provide such an improved fusion fixing apparatus which operates with low compressive forces and enables a substantially planar contact between the image carrier material and the rollers during fixing of the toner image.

In accomplishing the foregoing objects, there has been provided in accordance with the present invention an apparatus for fusion fixing thermoplastic toner images on an image carrier by means of heat and pressure, comprising: a heatable fixing roller comprising a first extension tube, a first cylindrical cover surrounding the first extension tube and being comprised of an elastic, heat- and permanent deformation-resistant material, and a first tubular sleeve pulled over the first cylindrical cover, with the first tubular sleeve having a polytetrafluoroethylene surface; a pressure roller mounted adjacent to the fixing roller, the pressure roller comprising a second extension tube, a second cylindrical cover surrounding the second extension tube and being comprised of an elastic, heat- and permanent deformation-resistant material, and a second tubular sleeve pulled over the second cylindrical cover; means for selectively engaging and disengaging said pressure roller against the fixing roller; and means for driving the pressure roller and the fixing roller at the same speed when the rollers are engaged, whereby the image carrier material is transported between the rollers without blurring the images thereon. Preferably the apparatus further comprises means for applying an anti-adherence medium to the fixing roller.

In a preferred embodiment, the material comprising the first and second cylindrical covers is sufficiently elastic that the contact surface between the fixing roller and the pressure roller in the engaged position is substantially planar during passage of the image carrier material between the rollers. The first cylindrical cover preferably comprises an open-cell foamed silicon material or an expanded rubber with a density between about 0.2 and 1.10 g/cm$^3$.

Further objects, features and advantages of the present invention will become apparent from detailed description of preferred embodiments which follows, when considered with the attached figures of drawing.

DETAILED DESCRIPTION OF PREFERRED EMBODIMENTS

According to the invention, both the fixing roller and the pressure roller are composed of an extension tube, a cylindrical cover, and a sleeve. The cylindrical cover consisting of an elastic, heat- and deformation-resistant material is applied to the extension tube, and tubular sleeves are then pulled over the covers on the two rollers. Due to this design, a planar contact is produced between the fixing roller and the pressure roller during passage of the image carrier material between the contacting rollers.

By providing a substantially planar contact surface between the rollers, sticking of the image carrier material to the fixing roller is avoided, so that (contrary to the other known fixing devices) means for separating the image carrier material from the fixing roller, such as mechanical fingers, can be dispensed with.

In one embodiment of the present invention, the extension tube of the fixing roller is mounted on a driving shaft, and friction wheels are arranged near the front surfaces of the driving shaft. These friction wheels engage corresponding friction wheels mounted near the front surfaces of the shaft of the pressure roller and engage the pressure roller when the roller is in the engaged position, so that it is entrained by the fixing roller and caused to rotate at the same speed as the fixing roller. For this purpose, the friction wheels on the driving shaft or on the shaft of the pressure roller are connected with overriding clutches which are mounted, respectively, on the driving shaft and on the shaft of the pressure roller.

The sleeve preferably consists of a thin-walled, flexible polytetrafluoroethylene tube in which glass fibers or corrosion-resistant helical steel strips are incorporated to increase its mechanical strength. The readiness for operation of the fusion fixing apparatus according to the invention and its trouble-free performance are largely dependent on the working life of the sleeves of the fixing and/or pressure rollers. If slip-on sleeves are used as jackets, the jackets can be replaced in a particularly simple manner, thus contributing to a reduction in the cost of the fixing apparatus and rendering in the cost of the fixing apparatus and rendering its maintenance less expensive.

Preferably, the sleeve consists of an extruded polytetrafluoroethylene tube.

Figure 1:
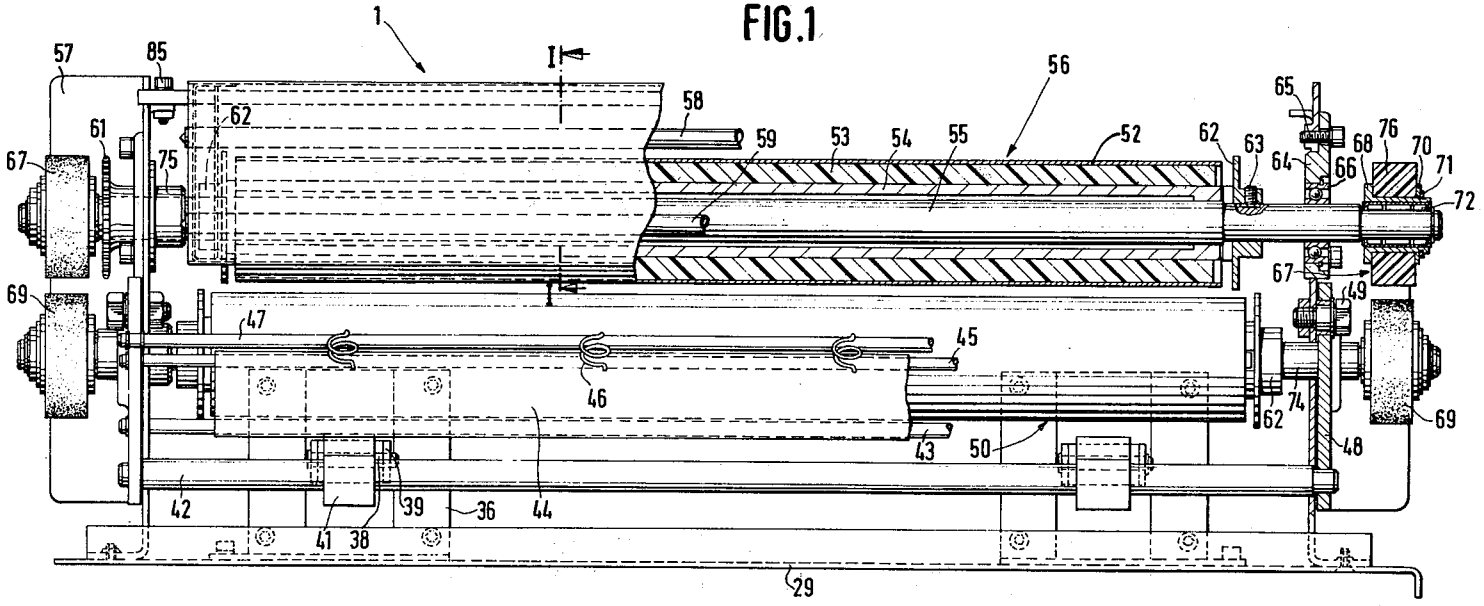
FIG. 1 is a side-view of a portion of the fusion fixing apparatus according to the invention, partly in section and partly broken away.
Figure 2:
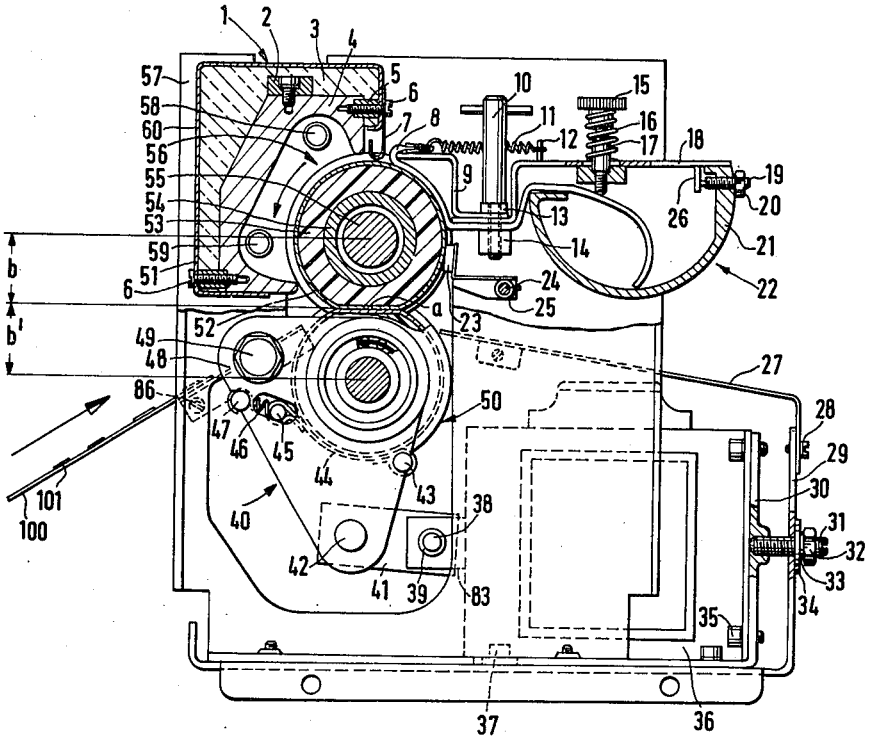
FIG. 2 is an end-view, partly in section, of the inventive apparatus seen along the line I—I of FIG. 1.

In the following, a preferred embodiment of the invention will be described in detail with reference to the drawings. FIGS. 1 and 2 show a preferred embodiment of a fusion fixing apparatus 1 according to the invention, with a heated fixing roller 56.

In addition to the fixing roller, the fusion fixing apparatus 1 comprises a pressure roller 50, an engaging and cleaning device 40, a wetting device 22, and a heating chamber 60.

The frame of the fusion fixing apparatus 1 comprises a side plate 57 to which the heating chamber 60 is attached. The heating chamber 60 is surrounded by a metal sheet covering 51 which partially encloses a space of square-shaped cross-section, but is open toward the fixing roller 56 over an inclined surface through which the fixing roller 56 projects with a portion of the circumference of its sleeve 52 into the interior of the heating chamber 60.

The heating chamber 60 contains two radiators, 58 and 59, which extend parallel to the driving shaft 55 and are arranged near the points where the fixing roller 56 enters and leaves the heating chamber 60. Alternatively, only one radiator may be provided. The heating chamber 60 is fastened by means of screws over the reflector 4 to the attachment rail 2 and thus is screwed to both side plates 57. An insulating layer 3 is embedded between the reflector 4 and the metal sheet 51, which is screwed by screws 6 to the reflector 4.

A heat insulator 7, which is fastened to one of the outside surfaces of the metal sheet 51 in a manner such that it can be moved in slotted holes, rests by its own weight with its curved end on the sleeve 52 of the fixing roller 56 and seals the gap where the fixing roller 56 enters the heating chamber 60, thus avoiding loss of radiant heat from the heating chamber 60.

The fixing roller 56 and the pressure roller 50 each consist of an extension tube 54, a cylindrical cover 53, and a sleeve 52. The cylindrical cover—which consists of an elastic, heat- and deformation-resistant material with a density of 0.24–0.30 g/cm$^3$, a breaking strength of 400 kilo-Pascal (kpa) at 23° C., 350 kPa at 175° C., 260 kPa at 200° C. and a breaking tension of 105 percent at 23° C., 75 percent at 175° C. and 60 percent at 200° C.—is applied to the extension tube 54, and the tubular sleeve 52 is pulled over the cover of each roller. The extension tube 54 of the fixing roller 56 is mounted on the driving shaft 55. Limiting disks 62 are attached at both ends of the extension tube 54 and are fastened by set screws 63 in their position on the driving shaft 55. For the sake of clarity, only set screw 63 of the right-hand limiting disk 62 is shown in FIG. 1.

The two ends of the driving shaft 55 are passed through bearing flanges 64. On each end of the shaft, overriding clutches 72 are mounted which are surrounded by flange bushings 68. The flange bushing 68 is provided with a friction layer. When the pressure roller 50 is in the engaged position, the friction layer of the flange bushing 68 engages the friction lyaer of the oppositely positioned friction wheel 69, which is mounted near one of the front ends of the shaft 74 of the pressure roller 50. The overriding clutch 72 ensures that the pressure roller 50 resting against the fixing roller 56 is carried along at the same speed as the fixing roller 56, which is driven. The two rollers must have the same speed when a toner image 101 is fused onto an image carrier material 100. This is necessary to avoid blurring of the toner image on the image carrier material. When the pressure roller 50 is forced against the fixing roller 56, a contact surface "a" is formed between the rollers as is shown in FIG. 2. This contact surface "a" is planar while the image carrier material 100 is passed between the two adjacent rollers 50 and 56. When the two rollers contact each other, the distance between the centers of the two axes of the rollers is uniformly reduced. This means that the radius extending from the center of the fixing roller 56 is to the point of contact is reduced as much as the radius extending from the center of the pressure roller 50 to the point of contact. As a consequence of the properties of the materials from which the two rollers are made, and because of the radii of the two rollers, a relatively large planar contact surface "a" results which guarantees good fusion of the toner image 101 on the image carrier material 100. The opposite pairs of friction wheels 67 and 69, which are mounted on the driving shaft 55 and the shaft 74, guarantee, by means of the integrated overriding clutches 72, that the two rollers 50 and 56 rotate at exactly the same speed within their area of contact "a".

First, the two friction wheels 67 are carried along by the overriding clutches 72 mounted on the driving shaft 55 of the fixing roller 56. When the two rollers 50 and 56 are in contact with each other, the two driven friction wheels 67 engage the friction wheels 69 mounted opposite on the shaft 74, thus causing the pressure roller 50 to rotate.

Minor differences in the length of the unwindings of the rollers 50 and 56, and/or different degrees of deformation b and b', which cannot be ruled out altogether, may cause the two rollers 50 and 56 to rotate at different rates of revolution, although their circumferential speed is the same. This means, in other words, that, if the pressure roller 50 is carried along by the positive connection with the driven fixing roller 56, a higher rate of revolution of the shaft 74 than of the driving shaft 55, which could result, may be compensated for because the shaft 74 rotates freely within the overriding clutches 72 integrated in the friction wheels 69.

If the rate of revolutions of the shaft 74 is slightly lower, the numbers of rotation are balanced out by slip betweeen the friction layers 76 of the friction wheels 67 and 69. The friction wheel 67 is fixed in its position on the flange bushing 68 by a fitting disk 70 secured by a guard ring 71. The bearing flange 64 contains a ball bearing 66 through which the driving shaft 55 is passed. By means of a screw 65, the bearing flange 64 is attached to one of the planes of the angled side plate 57. The side plate 57 is designed as a right angle, one surface of which extends normally to the drawing plane of FIG. 1 and is screwed to the main frame 29 of the fusion fixing apparatus 1.

The two side walls of the engaging and cleaning device 40 are designed as pivot bearings 48 and are located at the outside of the angled surfaces of the side plates 57. Each pivot bearing 48 may be pivoted about a fitted bolt 49 which is passed through the pivot bearing 48 and the angled surface of the side plate 57 and is screwed to a nut on the inside of the side plate 57. A connection shaft 42 which is supported in the pivot bearings 48 carries two connecting pieces 41 which extend parallel to the pivot bearings 48 and may be pivoted about the connection shaft 42. To each connecting piece 41, an armature plate 83 is linked by a bolt 38 and is fixed at each side by locking washers 39. Each of the armature plates 83 is part of a solenoid 36 and is pulled along guide means into the interior of the magnet when the magnet is energized. By this movement and that of the associated connecting piece 41, the engaging and cleaning device 40 is pivoted so that the pressure roller 50 is pressed against the fixing roller 56. If the solenoid magnet 36 is not energized, the armature plate 83 is moved to the left by the weight of the engaging and cleaning device 40 (see FIG. 2), and the pivoting movement of the engaging and cleaning device 40 causes the pressure roller 50 to disengage itself from the fixing roller 56.

The pressure roller 50 also serves as a cleaning roller and, for this purpose, is provided with a felt wiper 44 which extends over part of its circumference and is held in position at one of its ends by a clamping bar 43 and at its other end by a tension bar 45, the latter being tensioned by a tension spring 46 and a tensioning holder 47.

The solenoid 36 is fastened to the main frame 29 by means of fitted bolts 37 and may be displaced within certain limits in the horizontal direction by an adjusting screw 31. The adjusting screw 31 is secured by an adjusting nut, and a locking washer 33 and a disk 34 are slipped on the adjusting screw 31 between the adjusting nut 32 and the main frame 29. One end of the adjusting screw 31 is passed through an opening in an adjusting plate 30, which may be in the form of an angle, and rests against the solenoid 36 to which the adjusting plate 30 is connected by means of disks 35. A sheet-metal guide 27 for the image carrier material 100 is attached to the main frame 29 by screws 28. Over a feed plate 86, the image carrier material 100 is fed into the gap between the fixing roller 56 and the pressure roller 50 and leaves the fusion fixing apparatus over the sheet-metal guide 27.

A thermostat 23, which is connected with a connection shaft 24 provided with an adjusting ring 25 rests against the fixing roller 56. During operation of the fusion fixing apparatus according to the invention, the surface temperature of the fixing roller 56 is constantly measured by the thermostat 23.

The heating chamber 60 is provided with an attachment rail 2 with holes therein through which fixing screws 85 are passed. These screws are screwed to the horizontally curved ends of one surface of the angled plates 57, which are likewise provided with holes.

The driving shaft 55 carries an adjusting ring 75 which is adjacent to the ball bearing of the bearing flange 64 which, together with the driving sprocket 61, also positioned on the driving shaft 55 next to the bearing flange 64, serves for axially securing the driving shaft 55. A driving sprocket 61, which is positioned on the driving shaft 55 between the friction wheel 67 and the aforesaid surface of the angled plate and may engage a chain drive (not shown), is actuated by an electromotor.

The wetting station 22 comprises a semi-cylindrical container 21 for the anti-adhesion fluid, e.g., silicon oil, which is covered by a cover plate 18. An angular extension 26 of the cover plate 18 reaches into the interior of the container 21 and is in resilient contact with an adjusting screw 19 which is secured by a counter nut 20. By means of the adjusting screw 19, the cover plate 18 may be displaced in the direction of the fixing roller 56, if desired. Beyond the container 21, the cover plate 18 is twice bent at angles of 90°. Guide bushings 17 for the tightening screws 15 are passed through two openings in the cover plate 18. Each of the tightening screws 15 is surrounded by a compression spring 16, one end of which rests against the outer surface of the cover plate 18, while the other end presses against the head of the tightening screw 15. The wetting wick 8 is passed to the outside over a reentrant edge of the container 21 and is guided along the underside of the angular section of the cover plate 18 in the direction of the fixing roller 56. The wetting wick 8 rests on a portion of the circumference of the fixing roller 56, and between the container 21 and the fixing roller 56 it is passed over a clamping bar 14. The clamping bar 14 extends below the angular section of the cover plate 18, on which, in turn, the angular wick carrier 9 rests. Between the clamping bar 14 and the angular section of the cover plate 18, the wetting wick is clamped tight by means of a tommy screw 10 which rests on the upper surface of the angular wick carrier 9 by means of a cup spring 13. By turning the tommy screw 10, the wetting wick 8 is clamped tight in one position. In order to guarantee that the wetting wick closely hugs the fixing roller 56 and thus wets it thoroughly with the anti-adhesion fluid, the other end of the wetting wick 8 is held in a tension spring 11 which is hooked to a ring 12 on the cover plate 18. The wick 8 is conducted in such a manner that it is deflected by the end of the wick carrier 9, which is about at the level of the apex of the fixing roller 56. The tension spring 11 maintains the tension in the wetting wick 8, thus ensuring close contact between the wick 8 and the circumference of the fixing roller 56.

The fusion fixing apparatus according to the invention operates as follows:

When the start button of the copying apparatus is pushed, the fixing roller 56 is actuated by the machine drive and the driving sprocket 61 is actuated by the chain drive mentioned above.

At the same time, the radiators 58 and 59 are switched on and heat the sleeve 52 of the fixing roller 56 to the required operating temperature. Together with a measuring and control unit (not shown), a thermostat 23, resting against the fixing roller 56 by the action of a spring, controls the operating temperature of the sleeve 52 and switches the radiators on and off as required. After the two radiators 58 and 59, which may have the same output, have been switched off for the first time and the operating temperature has been reached, it may be of advantage to supply the heat required for further operation, e.g., for the manufacture of multiple copies, by switching in only one of the radiators, i.e., either radiator 58 or radiator 59.

The reflecting heating chamber 60 which surrounds part of the fixing roller 56 allows a very rapid heating-up of the sleeve, both radiators 58, 59 being switched on until the required temperature has been reached. With a switching arrangement as described, the heating chamber 60 can still operate if one of the two radiators should break down, because in this case the still functioning radiator can be switched in. Of course, in this case correspondingly longer heating-up times must be accepted. An indicator lamp on the control panel of the copying machine indicates when the fixing roller 56 has reached the required operating temperature.

When the image carrier material 100 is fed into the copying machine, the engaging and cleaning device 40 is moved into the engaging position through an electrical switching element by the solenoids 36. By the pressure of the pressure roller 50 on the fixing roller 56, a large and substantially planar zone of contact is created between the surfaces of the two rollers, thus providing for a relatively long period of heat exchange during which the toner image 101 is fused onto the image carrier sheet 100.

When the engaging and cleaning device 40 is moved into contact with the fixing roller 56, the pressure roller 50 is driven at the same circumferential speed as the fixing roller 56, by the contact of the friction wheels 67 and 69 with each other and the simultaneous contact of the two sleeves 52.

By a solenoid (not shown in the drawing) which is actuated when the image carrier material 100 is drawn in, the wetting device 22 is swivelled so that part of the wetting wick 8 contacts the sleeve 52 of the fixing roller 56, as shown in FIG. 2. In this manner, the surface of the fixing roller 56 is uniformly wetted with a film of silicon oil, so that adhesion of the toner is avoided and the surface of the sleeve surrounding the fixing roller is simultaneously cleaned.

During passage of the image carrier sheet 100 with the toner image 101 through the gap between the fixing roller 56 and the pressure roller 50, the toner image 101 on the image carrier material 100 is fixed by contact with the heated fixing roller 56. After the number of copies selected by a preselector switch has been run off, the solenoid 36 becomes de-energized, so that the mechanical contact between the pressure roller 50 and the fixing roller 56 is interrupted. At the same time, the operating radiator, either 58 or 59, is switched off, so that the fixing roller 56 is no longer heated, and the wetting device 22 is retracted into its start position by a solenoid which is not shown in the drawing, so that the wetting wick 8 is lifted out of contact with the fixing roller 56.

What is claimed is:

1. An apparatus for fusion fixing thermoplastic toner images on an image carrier by means of heat and pressure, comprising:

a heatable fixing roller comprising a first extension tube, a first cylindrical cover surrounding said first extension tube and being comprised of an elastic, heat- and permanent deformation-resistant material, and a first tubular sleeve pulled over said first cylindrical cover, said first tubular sleeve having a polytetrafluoroethylene surface;

a pressure roller mounted adjacent to said fixing roller, said pressure roller comprising a second extension tube, a second cylindrical cover surrounding said second extension tube and being comprised of an elastic, heat- and permanent deformation-resistant material, and a second tubular sleeve pulled over said second cylindrical cover;

means for selectively engaging and disengaging said pressure roller against said fixing roller; and means for driving said pressure rolier and said fixing roller at the same speed when said rollers are engaged, whereby the image carrier material is transported between said rollers without blurring the images thereon.

2. An apparatus according to claim 1, further comprising means for applying an anti-adherence medium to said fixing roller.

3. An apparatus according to claim 1, wherein the material comprising said first and second cylindrical covers has a density of 0.24–0.30 g/cm$^3$, a breaking strength of 260 kilo-Pascal at 200° C. and of 350 kilo-Pascal at 175° C., and a breaking tension of 60 percent at 200° C. and of 75 percent at 175° C., so that it is sufficiently elastic that the contact surface between said fixing roller and said pressure roller in the engaged position is substantially planar during passage of the image carrier material between said rollers.

4. An apparatus according to claim 1, wherein said driving means includes a drive shaft on which said first extension tube of said fixing roller is mounted, first friction wheels arranged near the front of the driving shaft, a shaft on which said pressure roller is mounted, corresponding second friction wheels mounted near the front surfaces of said pressure roller shaft and engaging said first friction wheels when the pressure roller is in the engaged position, whereby the pressure roller is carried along at the speed of the fixing roller.

5. An apparatus according to claim 4, wherein the first friction wheels of the driving shaft and the second friction wheels of the pressure roller shaft include overriding clutches which are mounted on the driving shaft and on the pressure roller shaft.

6. An apparatus according to claim 1, wherein said first sleeve comprises a thin-walled, flexible polytetrafluoroethylene tube.

7. An apparatus according to claim 6, further comprising glass fibers incorporated into said tube in order to increase its mechanical strength.

8. An apparatus according to claim 6, further comprising corrosion-resistant, helical steel strips incorporated into said tube.

9. An apparatus according to claim 6, wherein said first sleeve comprises an extruded polytetrafluoroethylene tube.

10. An apparatus according to claim 1, wherein said first cylindrical cover comprises an open-cell foamed silicon material.

11. An apparatus according to claim 1, wherein said first cylindrical cover comprises an expanded rubber with a density between about 0.2 and 1.0 g/cm$^3$.

12. An apparatus according to claim 2, further comprising a heating chamber surrounding a portion of the circumference of said first tubular sleeve and two radiators in the interior of said heating chamber arranged near the points where said fixing roller enters and leaves said heating chamber.

13. An apparatus according to claim 2, further comprising a heating chamber surrounding a portion of the circumference of said first tubular sleeve, wherein said applying means is arranged opposite to the heating chamber and comprises a container for the antiadherence medium, and a wetting wick which issues from said container and rests against part of the circumference of said first tubular sleeve.

14. An apparatus according to claim 13, wherein the wetting wick is loosely inserted into the interior of the container and the end of the wick which is outside of the container rests against a wick carrier and is tensioned by a tension spring.

15. An apparatus according claim 1, wherein said means for selectively engaging includes means for providing a relatively planar contact area therebetween.

* * * * *